US006494121B1

(12) United States Patent
Hu

(10) Patent No.: US 6,494,121 B1
(45) Date of Patent: Dec. 17, 2002

(54) ASSEMBLING SCREWDRIVER WITH HEXAGONAL SOCKET DESIGN

(75) Inventor: Cheng-Te Hu, Tainan Hsien (TW)

(73) Assignee: Gong Fong Enterprise Co., Ltd., Tainan Hsien (TW)

( * ) Notice: Subject to any disclaimer, the term of this patent is extended or adjusted under 35 U.S.C. 154(b) by 0 days.

(21) Appl. No.: 09/988,440

(22) Filed: Nov. 20, 2001

(51) Int. Cl.[7] ..... B25B 23/00
(52) U.S. Cl. ..... 81/439; 81/438
(58) Field of Search ..... 81/439, 440, 438

(56) References Cited

U.S. PATENT DOCUMENTS 5,819,612 A * 10/1998 Anderson ..... 81/439
5,904,080 A * 5/1999 Anderson et al. ..... 81/439
6,076,432 A * 6/2000 Chang ..... 81/439
6,209,428 B1 * 4/2001 Anderson et al. ..... 81/439
6,250,185 B1 * 6/2001 Tsung ..... 81/439

* cited by examiner

*Primary Examiner*—James G. Smith
*Assistant Examiner*—Hadi Shakeri
(74) *Attorney, Agent, or Firm*—Rosenberg, Klein & Lee

(57) ABSTRACT

An assembling screwdriver with hexagonal socket is composed of a handle, a socket and a set of bits, the handle has a hexagonal socket holder with a pair of inner rails along the inner wall. The socket is in hexagonal inner shape, and has an outer diameter slightly smaller than the inner diameter of the socket holder of the handle, and comprises a pair of protuberances extending from the outer wall corresponding to the rails of the socket, an aperture on the wall between the protuberances, a block secured in the socket with a recess adapted to receive a spring and a bearing therein. The bit set includes a pair of bits, each bit is in hexagonal shape and has an aperture on one side adapted to receive a spring and a bearing therein. The two bits are placed in each end of the socket, while the socket is inserted in the socket holder of the handle with the bearing urged by the spring against the wall.

1 Claim, 5 Drawing Sheets

3-3

ASSEMBLING SCREWDRIVER WITH HEXAGONAL SOCKET DESIGN

BACKGROUND OF THE INVENTION

1. Field of the Invention

This invention relates to an assembling screwdriver, and more particular to a screwdriver with hexagonal socket holder design.

2. Description of the Prior Art

A conventional screwdriver comprises a handle and an integral bit, and the bit is in either a cross or minus type head. The head can be made in various sizes. Therefore, people need to prepare a number of screwdrivers with different heads and sizes for different purposes. Other than economic inefficiency, they also take more space to store. For this reason, a screwdriver with replaceable bits are designed which has a unit handle and various types and sizes of screwdriver bits in a separated way, however, the screwdriver bits are easy to be misplaced and makes the whole unit useless. Further, hexagonal bolt and nut are used in various purposes, in many occasion, both screwdriver and hexagonal socket are used at same time, therefore, if a screwdriver also equipped with hexagonal socket is the most favorable tool, it corresponds not only economically, but also convenience.

SUMMARY OF THE INVENTION

It is the primary object of the present invention to provide with a multi-purpose hand tool which functions as a screwdriver with various types and sizes of bits and as a socket.

It is another object of the present invention to provide with a multi-purpose hand tool which is easy to exchange the bits and takes less space to store.

DETAILED DESCRIPTION OF THE PREFERRED EMBODIMENT

Figure 1:
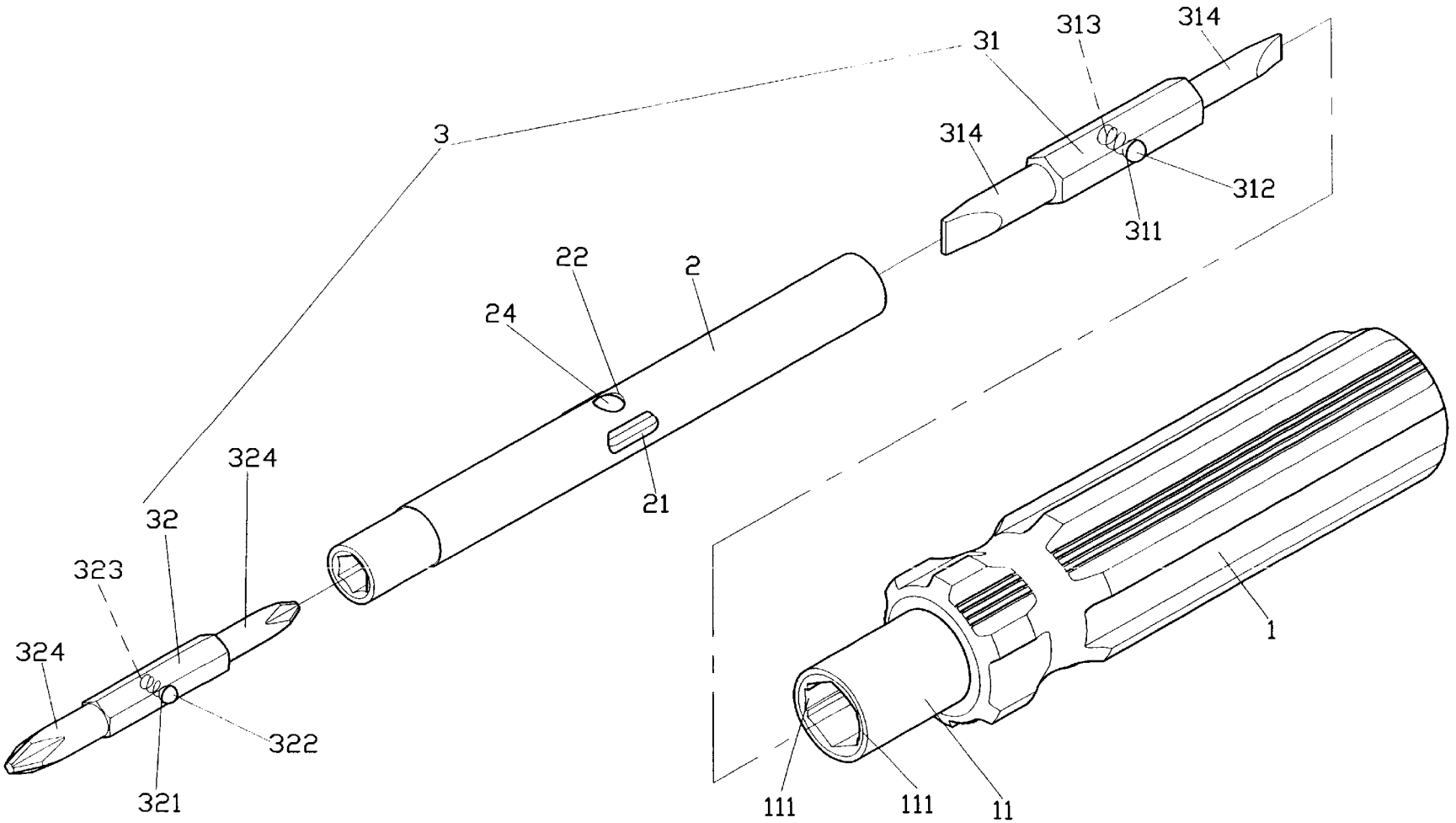
FIG. 1 is an exploded view of the present invention.
Figure 2:
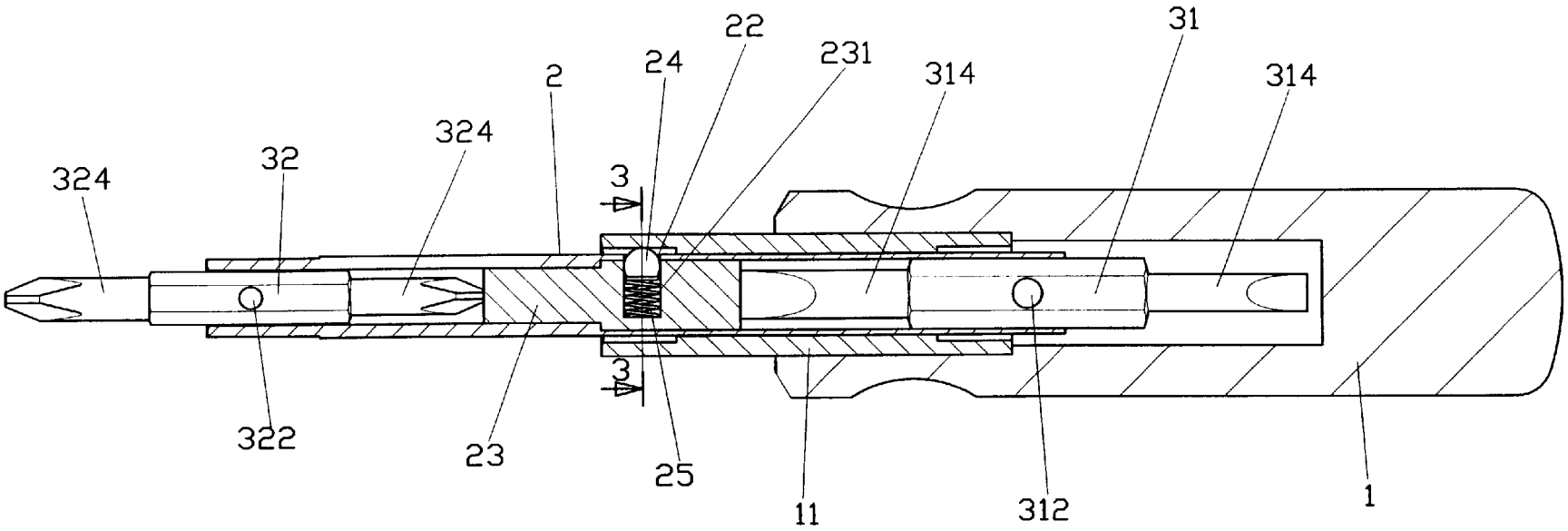
FIG. 2 is a side cross section view of the present invention.

Referring to FIGS. 1 and 2, the multi-purpose hand tool of the present invention is generally composed of a handle 1, a socket 2 and a set of bits 3.

The handle 1 has a longitudinal body having an opening end with a socket holder 11 extending inwardly. The inner wall of the open end of the socket holder 11 is hexagonal, and has a pair of rails 111 on the inner wall.

The socket 2 has a smaller outer diameter than the minimum inner diametric extent of the socket holder 11 and is in hexagonal shape at its inner wall. A block 23 is inserted in the middle of the socket 2. Block 23 is formed with a pair of protuberances 21 that extend through corresponding openings formed through the wall of socket 2, and aligned with rails 111. An aperture 22 is formed through the wall of socket 2 between the openings for protuberances 21. The block 23 has a recess 231 aligned with aperture 22 and adapted to receive a spring 25 and a bearing 24 therein. The bearing 24 has an outer diameter slightly larger than the diameter of the aperture 22, so that a portion of the bearing 24 is urged by the spring 25 to extend through the aperture 22. The diameter of the aperture 22 is first drilled to have a larger size than bearing 24, which allows the bearing 24 to pass therethrough, and then the diameter of the aperture 22 is processed to be smaller than the outer diameter of the bearing 24.

The bit set 3 includes two bits 31 and 32 each having a hexagonal shape at the center with diametric cross sectional dimensions slightly smaller than the corresponding inner diametric dimensions of the socket 2. One end of the hexagonal center of each bit 31 and 32 has a recess 311, 321 to accommodate a bearing 312, 322 and a spring 313, 323, and two different types of bits are formed at respective ends. The recesses 311 and 321 have a diameter smaller than the outer diameter of the bearings 312 and 322. The bit 31 includes a pair of MINUS (–) heads 314 at respective ends with different sizes, and the bit 32 has also a pair of CROSS (+) head 324 at respective ends with different sizes.

Figure 3:
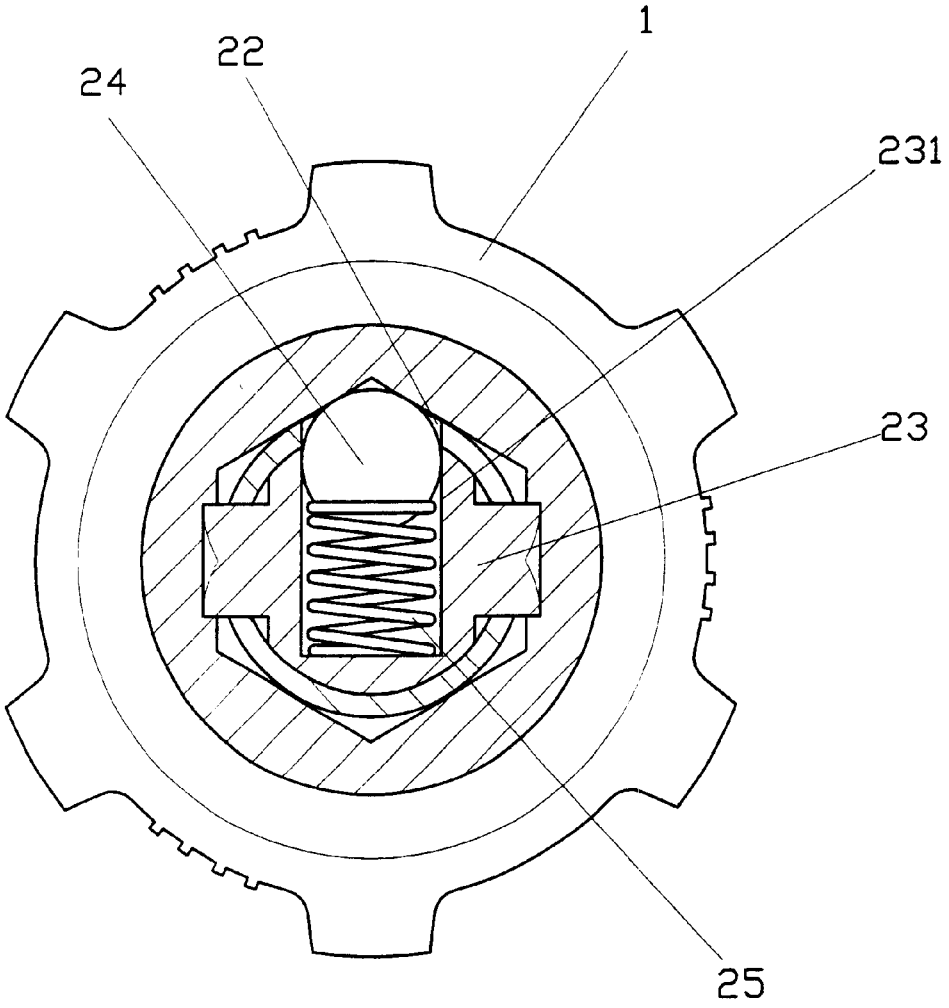
FIG. 3 is a view taken along line A—A of FIG. 2, partially sectioned.

To assemble the present invention, as shown in FIGS. 2 and 3, insert one end of each bit 31 or 32 into the socket 2 and press with force so that the bearing 312 or 322 will be against the wall which secure the bit 31 or 32 within the socket 2. Whereas the other end of each bit 31 or 32 extends outwardly form the socket 2. Finally, insert the socket 2 into the socket holder 11 of the handle 1 and press with force so that the protuberances 21 of the socket 2 are inserted into the rails 111 of the socket holder 11, and the bearing 24 is against the hexagonal wall of the socket holder 11.

Figure 4:
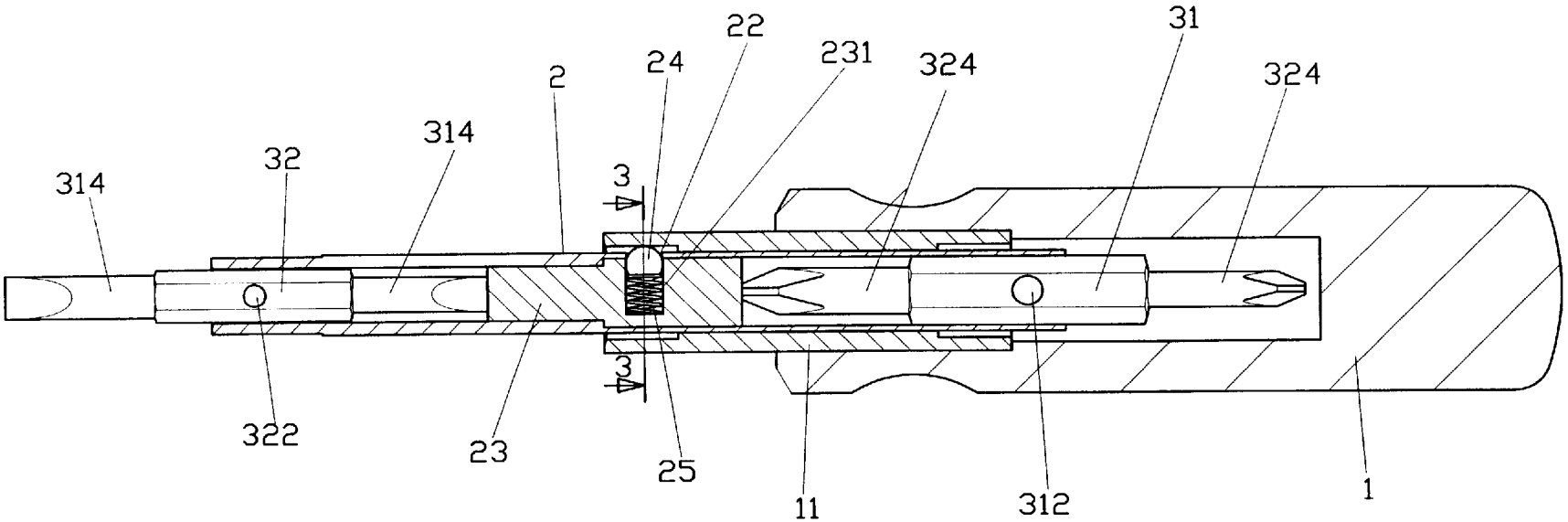
FIG. 4 is a side cross section view of FIG. 1, showing a screwdriver mounted on the handle.

To exchange the bit from one head to another, for instance to exchange the cross head 324 from one size to the other, simply pull the bit 32 outward from the socket 2 and insert the head of the bit 32 which is not in use into the socket 2, as shown in FIG. 4. Likewise, to exchange the bit 31, simply pull the socket 2 outward and insert the other end into the socket holder 11.

Figure 5:
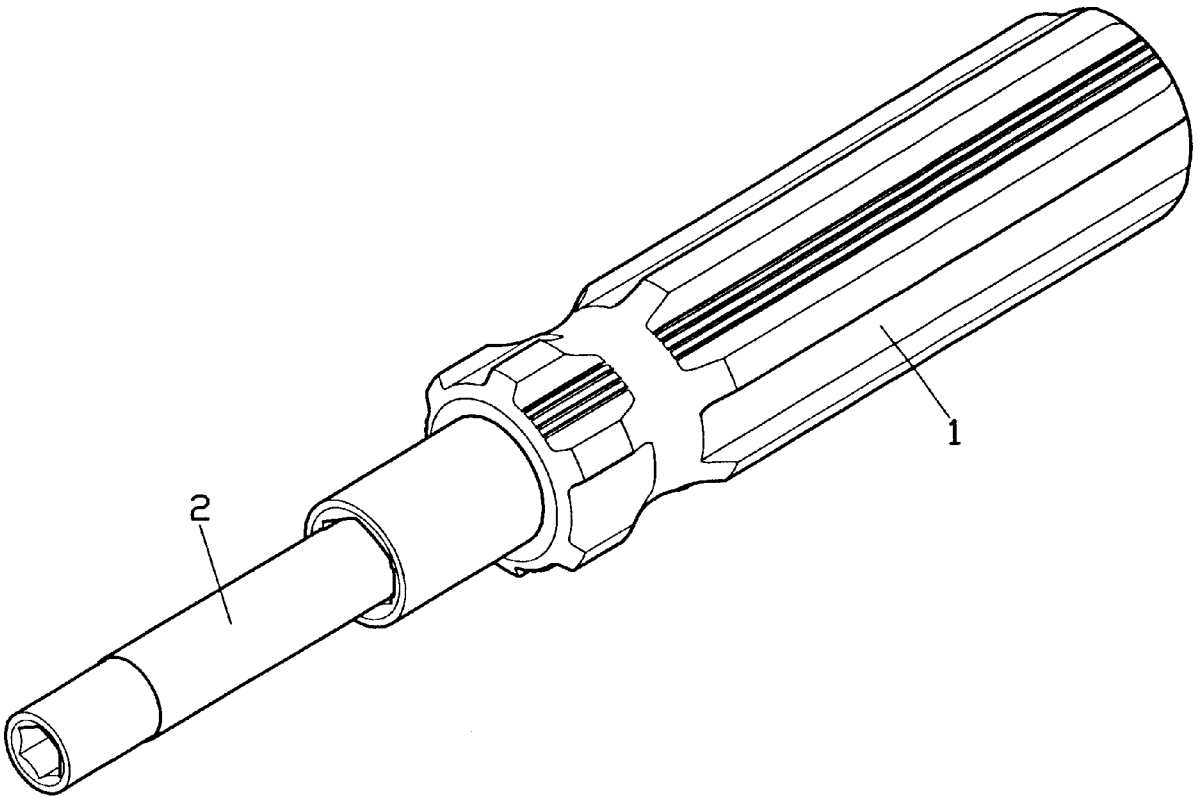
FIG. 5 is another side cross section view of FIG. 1, showing a hexagonal head mounted on the handle.

Moreover, by taking away the socket 2 off from the handle, the socket holder 11 is able to function as a hexagonal socket, as shown in FIG. 5, or the socket 2 and the handle 1 also function as a hexagonal socket.

I claim:

1. An assembling screwdriver with a hexagonal socket holder design, comprising:

a handle including a socket holder having an axially extended first bore formed therein, said first bore being defined by an inner wall portion having a substantially hexagonal cross-sectional contour, said inner wall portion having formed therein at least a pair of axially extending rail slots offset one from the other;

an elongate socket having a tubular wall with a substantially cylindrical outer contour and a hexagonally shaped second bore defined by an inner surface of said tubular wall;

a block disposed within said second bore of said socket and being formed with a pair of protuberances extending through corresponding openings formed through said tubular wall of said socket, said socket having an aperture formed through said tubular wall between said openings for said protuberances, said block having a recess formed therein aligned with said aperture to accommodate an elastic element, said elastic element comprising a bearing having a larger diameter than a diameter of said aperture and a spring for biasing said bearing to have a portion thereof extend through said aperture; and, a plurality of bits respectively coaxially received within said second bore at opposing ends of said socket, each of said bits having a pair of screw head driving portions of predetermined configuration extending in an axially opposed manner with respect to a central portion having a substantially hexagonal cross-sectional outer contour, each said central portion having a second aperture formed therein, each said central portion including a second spring biased bearing protruding radially outward through said second aperture to engage said socket, one end of each said bit extending outwardly from a respective end of said socket.

* * * * *